United States Patent [19]

Schneiter et al.

[11] Patent Number: 4,836,255

[45] Date of Patent: Jun. 6, 1989

[54] AZIDE GAS GENERANT FORMULATIONS

[75] Inventors: Fred E. Schneiter, North Ogden; Robert D. Taylor, Hyrum, both of Utah

[73] Assignee: Morton Thiokol, Inc., Chicago, Ill.

[21] Appl. No.: 158,180

[22] Filed: Feb. 19, 1988

[51] Int. Cl.[4] ..... C06B 35/00

[52] U.S. Cl. ..... 149/35; 149/61; 280/727

[58] Field of Search ..... 149/35, 61, 45, 43; 280/741, 727

[56] References Cited

U.S. PATENT DOCUMENTS

| | | | |
|---|---|---|---|
| 3,865,660 | 2/1975 | Lundstrom | 149/35 |
| 3,947,300 | 3/1976 | Passauer et al. | 149/35 |
| 3,996,079 | 12/1976 | DiValentin | 149/35 |
| 4,203,787 | 5/1980 | Kirchoff et al. | 149/35 |
| 4,547,235 | 10/1985 | Schneiter et al. | 149/35 |
| 4,696,705 | 9/1987 | Hamilton | 149/35 |
| 4,698,107 | 10/1987 | Goetz et al. | 149/35 |

OTHER PUBLICATIONS

*Encyclopedia Britannica,* 15th Ed., vol. 9, p. 3 (1980), Tullanox 500 brochure published by Tulco, Inc.

*Primary Examiner*—Stephen J. Lechert, Jr.
*Attorney, Agent, or Firm*—George Wheeler; Gerald K. White

[57] ABSTRACT

A gas generant composition especially adapted for inflating automotive airbags in the event of a vehicle collision to protect the occupants of the vehicle from injury. The composition consists essentially of 65–74% alkali metal azide; 10–28% ferric oxide; 6–16% sodium nitrate; 0.1–2% fumed silica; and 0–2% molybdenum disulfide. The composition burns at from about 1.2 to about 1.7 inches per second (about 3.0 to about 4.3 cm/sec).

1 Claim, 1 Drawing Sheet

AZIDE GAS GENERANT FORMULATIONS

TECHNICAL FIELD

The present invention relates to gas generant compositions which are burned to provide inflation for automobile airbag restraint systems and other inflatable airbag applications.

BACKGROUND ART

Airbag systems have been developed to protect the occupant of a vehicle, in the event of a frontal collision, by rapidly inflating a cushion or a bag between the vehicle occupant and the interior of the vehicle. The inflated airbag absorbs the occupant's energy to provide a gradual, controlled ride down, and provides a cushion to distribute body loads and keep the occupant from impacting the hard vehicle interior surfaces.

The most common airbag systems presently in use include an on-board collision sensor, an inflator, and a collapsed, inflatable bag connected to the gas outlet of the inflator. The inflator typically has a metal housing which contains an electrically initiated igniter, a particulate gas generant composition, and a gas filtering system. Before it is deployed, the collapsed bag is stored behind a protective cover in the steering wheel (for a driver protection system) or in the instrument panel (for a passenger system) of a vehicle. When the sensor determines that the vehicle is involved in a collision, it sends an electrical signal to the igniter, which ignites the gas generant composition. The gas generant composition burns, generating a large volume of relatively cool gaseous combustion products in a very short time. The combustion products are contained and directed through the filtering system and into the bag by the inflator housing. The filtering system retains all solid and liquid combustion products within the inflator and cools the generated gas to a temperature tolerable to the vehicle passenger. The bag breaks out of its protective cover and inflates when filled with the filtered combustion products emerging from the gas outlet of the inflator.

The requirements of a gas generant suitable for use in an automobile airbag are very demanding. The gas generant must burn very fast to inflate the airbag in about 30 milliseconds, but the burn rate must be stable, controllable, and reproducible to insure bag deployment and inflation in a manner which does not cause injury to the vehicle occupants or damage to the bag. The burn rate of the gas generant is thus very critical.

The gas generant must be extremely reliable during the life of the vehicle (ten or more years). Ignition must be certain, and the burn rate of the gas generant composition must remain constant despite extensive exposure of the composition to vibration and a wide range of temperatures. The gas generant is protected from moisture when sealed in the inflator, but should still be relatively insensitive to moisture to minimize problems during manufacture and storage of the gas generant and assembly of the inflator, and to insure reliability during the life of the airbag system.

The gas generant must efficiently produce cool, non-toxic, non-corrosive gas which is easily filtered to remove solid or liquid particles, and thus to preclude injury to the vehicle occupants and damage to the bag.

The gas generant must have good thermal stability and long term aging characteristics to insure functionality of the airbag system over the life of the vehicle.

The requirements of the preceding paragraphs prevent many apparently suitable compositions from being used as airbag gas generants.

Mixtures of sodium azide and ferric oxide are favored from the point of view of combustion temperature, filterability of solid or liquid combustion products, volume of gas produced per weight of composition, and lack of toxic gaseous products. They have a combustion temperature of no more than 1000° C., provide an efficient conversion to gas, produce almost pure nitrogen, and produce solid secondary combustion products in the form of clinkers which are easily trapped by the filtering system of the inflator.

Sodium azide and ferric oxide based gas generants have previously been less preferred than other compositions, however, because they burn unstably and slowly and are difficult to compact into tablets (U.S. Patent No. 4,203,787, issued to Kirchoff, et al. on May 20, 1980, column 2, lines 25 and following). An additional problem which has historically hindered the acceptance and usefulness of sodium azide and iron oxide based gas generants has been their propensity to absorb moisture under normal atmospheric conditions, which degrades the gas generant's physical properties and reduces its burn rate.

The compaction problem has been solved by adding molybdenum disulfide (Kirchoff, cited above, Example 6; U.S. Pat. No. 4,547,235, issued to Schneiter, et al. on Oct. 15, 1985, especially Column 3, lines 4–8).

In compositions containing no ferric oxide, the problem of unstable or slow burning has been addressed by adding a mixture of potassium nitrate and finely divided silica to the gas generant (Schneiter, et al., cited above, especially from column 2, line 50 to column 3, line 4, and in column 3, lines 8–24). The Schneiter reference has also proposed the use of sulfur to increase the burn rate, and in Example 8 provides a comparative example in which sodium azide, ferric oxide, and sulfur are combined. But the combustion products of this combination are shown by Schneiter, et al. to be more caustic than its preferred compositions, which employ a mixture of silica and potassium nitrate as a burn rate modifier. Sulfur also generates an unpleasant smell and toxic sulfur dioxide when burned.

The problem of increasing the burn rate of sodium azide and iron oxide gas generants has been addressed in many ways, such as using chemical additives and unique or special processing methods. We know of no prior art in which sodium nitrate is used as a burn rate modifier for a sodium azide and iron oxide gas generant.

U.S. Pat. No. 3,947,300, issued to Passauer, et al. on Mar. 30, 1976, teaches a gas generant comprising sodium azide, potassium nitrate, and silica. The reference suggests that lead oxide or ferric oxide can be added as "glass flux promoting oxides" (column 3, lines 7–13), but teaches away from adding large amounts of such oxides (column 3, lines 50–54).

The problem of degradation of airbag gas generants under humid conditions has not been substantially addressed in the relevant art. U.S. Pat. No. 3,996,079, issued to DiValentin on December 7, 1976, includes a perfunctory humidity test in Example 4, but does not test a composition containing ferric oxide or sodium nitrate and does not explain how the slower burning rate caused by humidity can be remedied. The humidity test in Example 4 of DiValentin was run at 0.02% by weight water vapor (1.5% relative humidity) and at 0.62% by weight water vapor (46% relative humidity).

The latter value is actually lower than the average relative humidity in July in the most highly populated areas of the United States, according to the Encyclopedia Britannica, 15th Ed., Volume 9, page 3 (1980).

A trade brochure of unknown publication date, published at least by Feb. 26, 1986 by Tulco, Inc., describes its TULLANOX 500 brand of hydrophobic fumed silica. It suggests the incorporation of this material in various products, for example match heads, match striker strips, and blasting powder, to retard moisture and improve water resistance. No suggestion is made that hydrophobic fumed silica would be useful in gas generant compositions.

To summarize, no prior art has shown how airbag gas generant compositions predominantly comprising sodium azide and ferric oxide can be made to burn faster, particularly when high humidity is a factor, without forming caustic products. The advantages of sodium azide and ferric oxide based airbag gas generants thus have not previously been realized. Sodium nitrate and hydrophobic fumed silica have not previously been used or suggested for use in airbag gas generant compositions.

SUMMARY OF THE INVENTION

The present invention is an improved airbag gas generant composition consisting essentially of an alkali metal azide (65 to 74%); ferric oxide (10 to 28%); sodium nitrate (5 to 16%); hydrophobic fumed silica (0.1 to 2%); and optionally, molybdenum disulfide (0 to 2%). (Note: all percentages herein are by weight unless otherwise indicated.) The composition is further characterized by its burning rate of from about 1.2 to about 1.7 inches per second (about 3.0 to about 4.3 cm/sec) when compressed into tablets.

DESCRIPTION OF THE PREFERRED EMBODIMENTS

Figure 1:
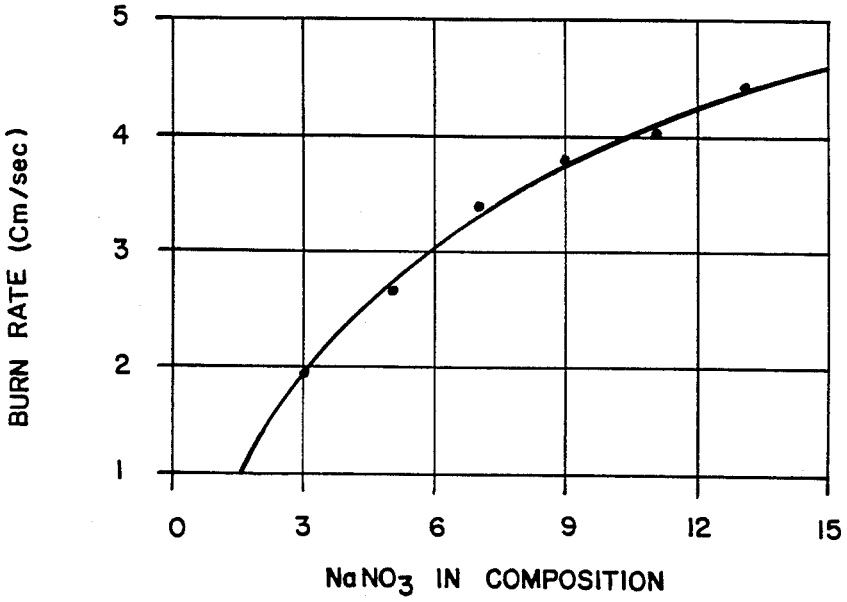
FIG. 1 is a plot of the data in Table IV, Examples 13–18.

Alkali metal azides are all useful herein; for commercial reasons sodium azide is presently preferred. The many advantages of azides as sources of nitrogen by combustion are set forth in the prior art. The preferred particle size of sodium azide is about 24 microns. More than 74% sodium azide is less preferred because an excess of sodium azide is carried into the residue. Less than 65% sodium azide is less preferred because the yield of nitrogen is lowered.

The ferric oxides useful herein are specified in some detail in U.S. Pat. No. 3,996,079 (identified previously), column 3, lines 12–23, hereby incorporated herein by reference. Pigment-sized ferric oxide (about 5.5 micron particle diameter, specific surface area about 8 square meters per gram) and transparent ferric oxide (0.7 to 0.9 micron particle diameter, specific surface area about 100 square meters per gram) can be used herein. The former is preferred, as it is less hygroscopic.

Sodium nitrate is preferred over other alkali metal nitrates because it has a larger influence on the burn rate and ignition characteristics of the composition than other alkali metal nitrates. Sodium nitrate is also more readily available than nitrates of other alkali metals. It is hygroscopic, however, and so is preferably used in combination with the hydrophobic silica discussed below to minimize susceptibility of the gas generant to humidity. The preferred sodium nitrate for use herein has a particle size of about 15 microns. The preferred amount of sodium nitrate is determined by its influence on the burn rate. Usually, more than 16% sodium nitrate increases the burn rate to an undesirable level, and less than 5% sodium nitrate provides a burn rate which is too low.

Hydrophobic silica as contemplated herein is fumed silica having a particle size of about 0.007 microns and a measured surface area of 225 square meters per gram, with trimethyl siloxyl groups bonded to its surface. Unlike conventional fumed silica, which is hydrophilic, hydrophobic silica repels moisture intensely. Hydrophobic silica imparts its hydrophobicity to compositions containing 2% or less of it by weight. Hydrophobic silica is sold under the trademark TULLANOX 500 by Tulco, Inc. under a license from Cabot Corporation, Boston, Mass. If more than 2% of this ingredient is used, the other ingredients will be diluted proportionally, which is undesirable.

The molybdenum disulfide used herein preferably has a particle size of about 15 microns.

The composition is fabricated by providing the ingredients in powdered form and dry or slurry blending the powders to form an essentially homogeneous mixture.

The mixture is then pelletized. The size and shape of the pellets, the force used to compress the mixture into pellets, and the original particle size distributions of the starting materials all influence the burning rate of the composition. Preferably, all these factors are regulated to maximize the burning rate, insofar as that is consistent with providing pellets having the necessary mechanical strength to readily withstand the automotive environment. One advantage of using a modifier to increase the burn rate of the composition is that the pellets can be made thicker, and thus more durable and less expensive per unit weight, without reducing the burn rate unacceptably.

Examples 1–2

The formulations shown in Table I were prepared. One part of each formulation was kept as a loose powder and a second part was formed into $\frac{1}{4}$ inch (6.35 mm) diameter tablets. The formulations differ only as to the source of ferric oxide. The transparent oxide of Example 1 initially contained more water (1.30%) than the regular ferric oxide of Example 2 (0.09%). The "initial water" figures of Table I are the product of the above water content numbers and the proportion of ferric oxide in the formulations.

The powder and tablet forms of each formulation were then maintained at 200° F. (93° C.) for 14 days in an unconfined space, after which they were reweighed. Each sample lost some weight, which was attributed to a loss of retained water. the samples in pellet form lost much less weight than those in powder form, and the transparent oxide samples lost more water, but a smaller proportion of their initial weight of water, than the corresponding regular oxide samples. The weight changes were slight.

Examples 3–8

The formulations shown in Table II were prepared and formed into $\frac{1}{4}$ inch (6.35 mm) diameter tablets. The tablets were stored at the indicated relative humidities at ambient temperature (about 72° F., or 22° C.) for 14 days. Weight gains are indicated as positive figures and weight losses are indicated as negative figures in Table II.

First looking at Examples 3 and 4, which contained 2% hydrophobic silica and respectively were formulated with transparent ferric oxide and regular ferric oxide, at 30% relative humidity they lost water weight. At 60% relative humidity, they each gained weight. The sample containing transparent ferric oxide gained much more than the other sample, but neither sample gained a significant amount of weight. At 90% relative humidity, which is a very severe test of the resistance of the compositions to humidity, each tablet of examples 3 and 4 remained intact.

Compared to Examples 3 and 4, the compositions of Examples 5 and 6 contained no hydrophobic silica, more sodium azide, less ferric oxide, and 10.8% sodium nitrate. Example 5 was made with transparent ferric oxide and Example 6 was made with regular ferric oxide. At 30% relative humidity Example 5 lost a small amount of weight and Example 6 gained weight; neither change appeared significant. At 60% relative humidity, the composition of Example 5 gained a little weight, but the composition of Example 6 gained 100 times as much weight as at 30% humidity. At 90% relative humidity, the formulations of Examples 5 and 6 absorbed enough water to dissolve them. This data shows that the absence of hydrophobic silica significantly increases water pick-up, to the point that the tablets are destroyed by high humidity.

The compositions of Examples 7 and 8 resemble those of Examples 3 and 4, except that Examples 7 and 8 contain sulfur and lack hydrophobic silica. At 30% relative humidity, Examples 7 and 8 came out like Examples 5 and 6. At 60% relative humidity, the transparent oxide picked up much more weight than the regular ferric oxide. But again, in the absence of hydrophobic silica, each tablet decomposed when subjected to 90% relative humidity.

The data of Table II shows that the present gas generants are susceptible to substantial humidity damage unless they contain hydrophobic silica. In compositions containing hydrophobic silica, the influence of humidity is slight at 60% relative humidity and clearly much less significant at 90% humidity than for compositions which lack hydrophobic silica. These results apply whether or not sodium nitrate is present.

Examples 9–13

Table III shows the formulations, pellet characteristics, and burn rates for the formulations of Examples 9–12. Example 9 contains stoichiometric proportions of sodium azide, ferric oxide (regular), and sodium nitrate, and Example 10 contains less than the stoichiometric amount of sodium azide and more than the stoichiometric amount of ferric oxide, and otherwise is identical to Example 9. The formulation adjustments in Example 10 increased the burn rate somewhat, but not dramatically, and not into the preferred range of from about 3 to about 4.3 centimeters per second. This shows that 5% sodium nitrate is less than the optimum amount in these formulations, even if other aspects of the formulations are adjusted to improve the burn rate.

Examples 11 and 12, like Example 9, employ stoichiometric amounts of the principle combustible ingredients, but contain progressively more sodium nitrate. The burn rates increase dramatically; the burn rate in Example 11 is at the minimum of the desired burn rate range, and Example 12 is within the desired range.

Table III thus shows the value of sodium nitrate for increasing the burn rate of gas generant compositions.

Examples 13–18

These examples confirm and quantify the effect of the proportion of sodium nitrate on the burn rate of these compositions. The compositions and burn rates are given in Table IV. Each formula was compressed into 6.35 mm diameter tablets, as before, then its burn rate was determined. The burn rate versus percent sodium nitrate for Examples 13–18 is plotted in FIG. 1. Given the other conditions of these examples, a burn rate of about three centimeters per second is provided by using about 6% sodium nitrate, and a burn rate of about 4.3 centimeters per second is provided by about 13% sodium nitrate. For other formulations, more or less sodium nitrate will be needed to meet these desirable minimum and maximum burn rates.

Example 19

Figure 2:
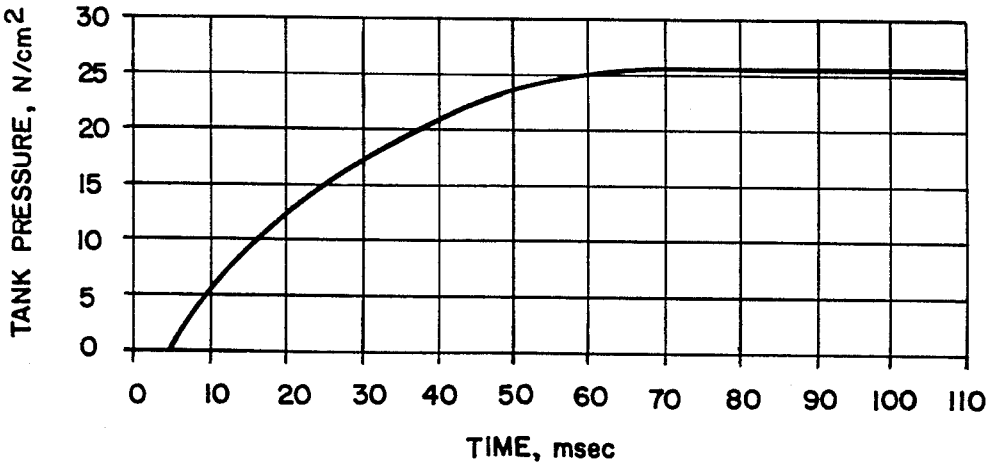
FIG. 2 is a plot of tank pressure versus time, as further discussed in Example 19.

80 grams of the pellets of Example 9 were placed in an inflator, the outlet of which was connected to a sixty liter tank. The composition was ignited and the gas pressure within the tank was plotted as a function of time to generate FIG. 2. As the plot shows, after 20 milliseconds the gas pressure in the tank was 12.9 $N/cm^2$, and by about 85 milliseconds the pressure reached its ultimate value of 25.3 $N/cm^2$. Thus, gas was generated at an appropriate rate to inflate an automotive airbag.

TABLE I

| Unconfined Aging at 93° C. for 14 Days | | |
|---|---|---|
| | Example (wt. %) | |
| Ingredient (wt. %) | 1 | 2 |
| $NaN_3$ | 63.77 | 63.77 |
| $Fe_2O_3(T)$[1] | 32.23 | — |
| $Fe_2O_3(R)$[2] | — | 32.23 |
| $MoS_2$ | 2.0 | 2.0 |
| $SiO_2(H)$[3] | 2.0 | 2.0 |
| Total | 100.00 | 100.00 |
| Initial Water[4] (wt. %): | 0.42 | 0.03 |
| Form | Weight change due to Aging (wt %) | |
| powder | −.050 | −.018 |
| pellets | −.013 | −.009 |

[1]transparent
[2]regular
[3]hydrophobic
[4]contributed by $Fe_2O_3$

TABLE II

| Humidity Aging for 14 Days at Ambient Temperature | | | | | | |
|---|---|---|---|---|---|---|
| | Example (wt. %) | | | | | |
| Ingredient | 3 | 4 | 5 | 6 | 7 | 8 |
| $NaN_3$ | 63.77 | 63.77 | 72.0 | 72.0 | 66.0 | 66.0 |
| $MoS_2$ | 2.0 | 2.0 | 1.0 | 1.0 | 2.0 | 2.0 |
| $Fe_2O_3(T)$ | 32.23 | — | 15.2 | — | 30.0 | — |
| $Fe_2O_3(R)$ | — | 32.23 | — | 15.2 | — | 30.0 |
| $NaNO_3$ | — | — | 10.8 | 10.8 | — | — |
| $SiO_2(H)$ | 2.0 | 2.0 | — | — | — | — |
| S | — | — | 1.0 | 1.0 | 2.0 | 2.0 |
| Total | 100.0 | 100.0 | 100.0 | 100.0 | 100.0 | 100.0 |
| Relative Humidity (%) | Weight Gain (Loss), Weight %, [1] | | | | | |
| 30 | −.058 | −.023 | −.076 | +.014 | −.070 | +.012 |
| 60 | +.007 | +.0221 | +.146 | +1.458 | +.764 | +.104 |
| | Qualitative Result | | | | | |

TABLE II-continued

| Humidity Aging for 14 Days at Ambient Temperature | | | | | | |
|---|---|---|---|---|---|---|
| | Example (wt. %) | | | | | |
| Ingredient | 3 | 4 | 5 | 6 | 7 | 8 |
| 90 | I[2] | I | D[3] | D | D | D |

[1]positive numbers are gains, negative numbers are losses
[2]tablet remained intact after test
[3]tablet dissolved in absorbed water during test

TABLE III

| Gas Generant Burn Rates | | | | |
|---|---|---|---|---|
| | Example (Wt. %) | | | |
| Ingredient | 9 | 10 | 11 | 12 |
| $NaN_3$ | 72.0 | 65.0 | 72.8 | 73.6 |
| $Fe_2O_3$(R) | 21.0 | 28.0 | 18.2 | 15.4 |
| $NaNO_3$ | 5.0 | 5.0 | 7.0 | 9.0 |
| $MoS_2$ | 1.0 | 1.0 | 1.0 | 1.0 |
| $SiO_2$(H) | 1.0 | 1.0 | 1.0 | 1.0 |
| Total | 100.0 | 100.0 | 100.0 | 100.0 |
| Pellet Data | | | | |
| diameter (mm) | 6.35 | 6.35 | 6.35 | 6.35 |
| density (g/cm$^3$) | 2.06 | 2.18 | 2.03 | 2.00 |
| thickness (mm) | 2.03 | 2.29 | 2.79 | 3.30 |
| weight (g) | .132 | .158 | .180 | .210 |
| Burn Rate[1]: | 2.15 | 2.44 | 2.97 | 3.43 |

[1]measured in cm/sec at a pressure of 690 N/cm$^2$ (1000 psi gauge)

TABLE IV

| Formulations for Examples 13-18 | | | | | | |
|---|---|---|---|---|---|---|
| | Example (wt. %) | | | | | |
| Ingredient | 13 | 14 | 15 | 16 | 17 | 18 |
| $NaN_3$ | 71.2 | 72.0 | 72.8 | 73.6 | 74.8 | 75.2 |
| $Fe_2O_3$ | 23.8 | 21.0 | 18.2 | 15.4 | 12.2 | 9.8 |
| $NaNO_3$ | 3.0 | 5.0 | 7.0 | 9.0 | 11.0 | 13.0 |
| $MoS_2$ | 1.0 | 1.0 | 1.0 | 1.0 | 1.0 | 1.0 |
| $SiO_2$(H) | 1.0 | 1.0 | 1.0 | 1.0 | 1.0 | 1.0 |
| Total | 100.0 | 100.0 | 100.0 | 100.0 | 100.0 | 100.0 |
| burn rate[1] | 1.95 | 2.6 | 3.4 | 3.8 | 4.05 | 4.4 |

[1]measured in cm/sec at a pressure of 690 N/cm$^2$

What is claimed is:

1. An airbag gas generant composition consisting essentially of

A. from 65 to 74 percent by weight of an alkali metal azide;

B. from 10 to 28 percent by weight ferric oxide;

C. from 5 to 16 percent by weight sodium nitrate;

D. from 0.1 to 2 percent by weight hydrophobic fumed silica; and

E. from 0 to 2 percent by weight molybdenum disulfide;

said composition having a burning rate of from about 3.0 to about 4.3 centimeters per second.

* * * * *